US005303462A

United States Patent [19]

Chitwood et al.

[11] Patent Number: 5,303,462

[45] Date of Patent: Apr. 19, 1994

[54] WIRE CRIMPING MACHINE

[75] Inventors: Billie B. Chitwood, Fort Worth; Carl A. Gilley, III, Grapevine, both of Tex.

[73] Assignee: Bell Helicopter Textron Inc., Fort Worth, Tex.

[21] Appl. No.: 966,277

[22] Filed: Oct. 26, 1992

[51] Int. Cl.[5] ..... H01R 43/04

[52] U.S. Cl. ..... 29/705; 29/721; 29/751; 29/753; 29/715

[58] Field of Search ..... 29/753, 751, 720, 721, 29/705, 714, 715

[56] References Cited

U.S. PATENT DOCUMENTS 4,087,908 5/1978 Fusco et al. ..... 29/753

4,649,621 3/1987 Dusel et al. ..... 29/720 X

*Primary Examiner*—Carl E. Hall

*Attorney, Agent, or Firm*—John M. Cone; William Lloyd Clayborn

[57] ABSTRACT

A wire crimping machine automatically adjusts the crimping means to the proper crimp depth for a selected size of wire and the size of the contact to be crimped onto the wire. The size of wire to be crimped is selected by the operator. As a wire is inserted into the machine for crimping, an arrangement of light emitting diodes, photo diodes, and associated circuits determine the wire's size and whether the wire is stripped. The crimping means is allowed to actuate only if the wire is stripped and the wire's size is the same as that selected by the operator.

17 Claims, 3 Drawing Sheets

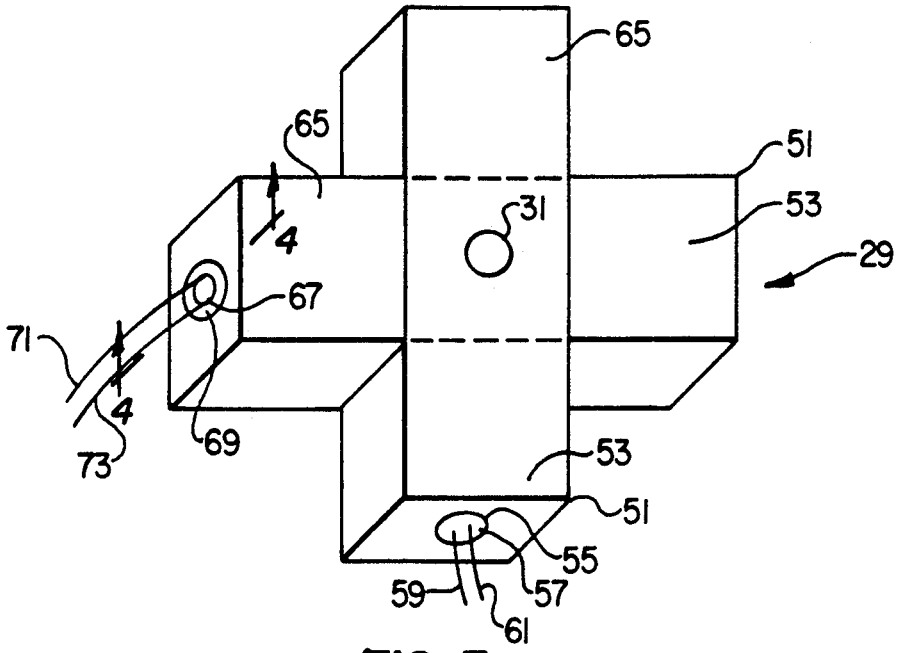
FIG. 3
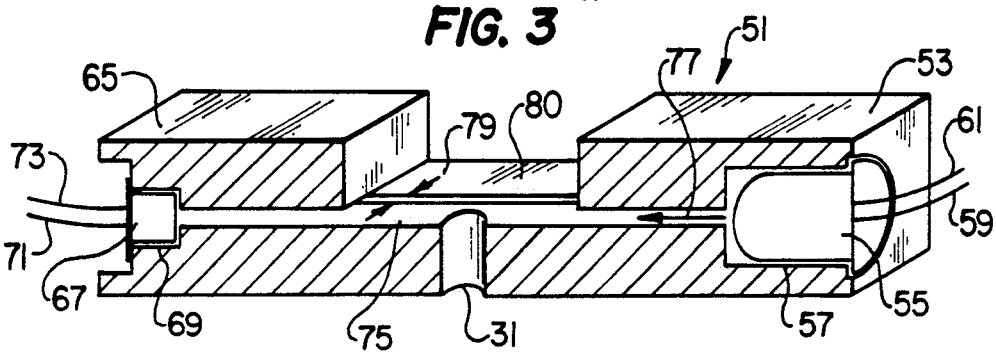
FIG. 4
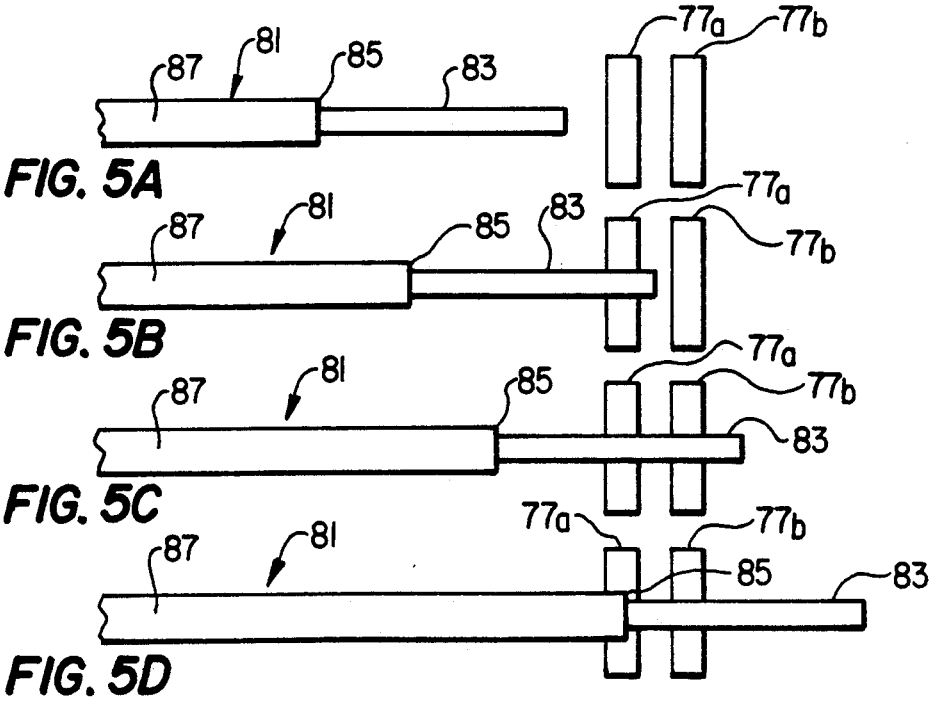
FIG. 5A
FIG. 5B
FIG. 5C
FIG. 5D

WIRE CRIMPING MACHINE

BACKGROUND OF THE INVENTION

The present invention relates to machines for crimping electrical contacts onto wires. Crimping machines are commonly used when a large number of contacts and wires must be crimped, for example, when manufacturing an aircraft wiring harness.

FIG. 1 shows an example of a prior art crimping machine 1, the Porta-Tac manufactured by Tri-Star Electronics, Inc., of Venice, Calif. In operation, the crimping machine automatically obtains a contact (not shown) from a magazine 3 and positions the contact adjacent to an opening 5. The magazine 3 contains a number of electrical contacts of a single type and size. The magazine 3 is removable, allowing the size and/or type of contact to be changed by changing the magazine. An operator (not shown) inserts a stripped end 7 of a wire 9 through the opening 5 and into the contact. When the stripped end 7 is properly positioned, the crimping machine 1 automatically crimps the contact onto the stripped end 7.

A contact of a given size may be satisfactorily crimped to a wire which is as much as two sizes smaller than the contact. For example, an 18 gauge contact may be used for an 18, 20, or 22 gauge wire. However, the crimping depth varies for the various combinations of contact and wire sizes. Thus, the machine 1 has an adjustment knob 11 which allows the operator (not shown) to set the appropriate crimping depth. In this particular machine, there are six settings. To minimize changing the magazine 3 and the adjusting knob 11, the operator will generally group the wires to be crimped by size.

Several crimping errors are possible when using the type of prior art machine described. An improper crimping depth setting will result in a defective crimp. If the crimping depth is too great, the contact may be crushed. If the crimping depth is not sufficient, a loose crimp will occur. In addition, it is possible to insert an unstripped wire into a contact. Each of the mentioned defects can be hazardous, expensive to correct, and, if not detected, cause major problems in use.

SUMMARY OF THE INVENTION

An object of the present invention is to eliminate the need for the operator of a crimping machine to adjust the crimping depth setting, thus eliminating the possibility of crushing a contact or making a loose crimp. A further object of the invention is to prevent crimping a contact on an unstripped wire. A further object of the invention is to provide a mechanism that may be easily added to existing crimping machines to improve their performance.

According to the present invention there is provided a machine for crimping contacts to wires having means for:

selecting the size of wire to be crimped;

determining the size of contacts contained in a container which supplies contacts to the crimping machine;

determining the size of the wire inserted into the crimping machine and whether the wire is stripped;

automatically adjusting the correct crimper depth setting responsive to the size of the contacts in the container and the selected wire size; and allowing the crimper to actuate only when the inserted wire is stripped and is the same size as the selected wire size.

BRIEF DESCRIPTION OF THE DRAWINGS

An embodiment of the invention will be described, by way of example only, with reference to the accompanying drawings, in which:

FIG. 3 is an orthographic view of the sensor assembly of the machine shown in FIG. 2;

FIG. 4 is a cut-away orthographic view of a sensor member viewed from the 4—4 plane in FIG. 3;

FIGS. 5A–D demonstrate schematically the operation of the sensor assembly of FIG. 3.

DETAILED DESCRIPTION

Figure 1:
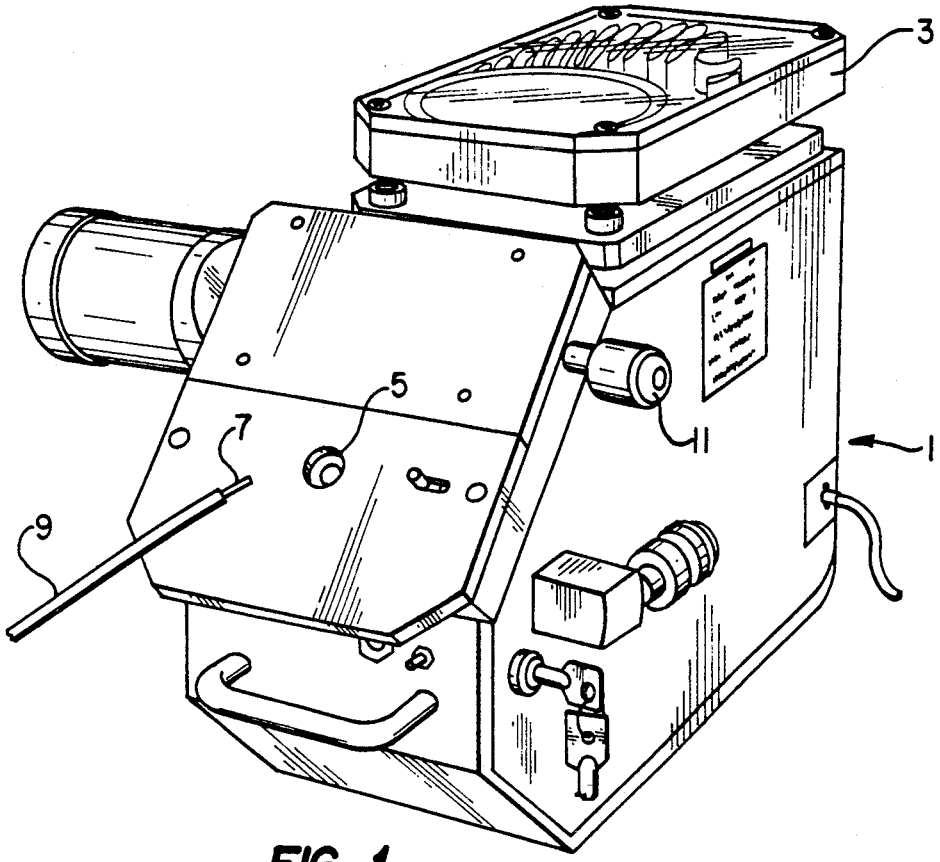
FIG. 1 is an orthographic view of a prior art crimping machine.
Figure 2:
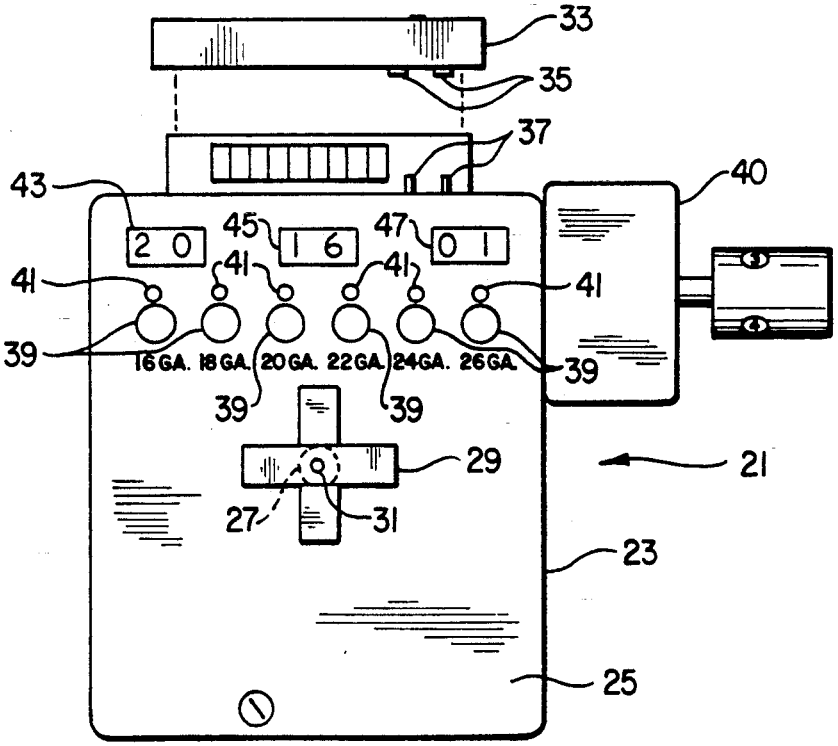
FIG. 2 is a front view of a crimping machine embodying the present invention.

Referring to FIG. 2, a wire crimping machine 21 includes a housing 23 having a front face 25. An opening 27 in the face 25 allows a wire (not shown) to be inserted into the machine 21. A sensor assembly 29 having a wire orifice 31 centered over the opening 27 is attached to the face 25. The sensor assembly 29 will be described in greater detail below.

A container 33 which is removably mounted on the housing 23 contains a supply of contacts (not shown) for the crimping machine 21. Several containers 33 are available, each containing contacts of a single size and type. When the container 33 is positioned on the crimping machine 21, at least one projection 35 depending from the underside of the container 35 depresses a corresponding electrical container switch 37. The containers 33 for each size of contact each have a unique pattern of projections 35. Thus, when the projection or projections 35 depress the container switch or switches 37, the switches 37 produce combinations of "on" and "off" signals which correspond to and identify the size of the contacts within the container 33.

In this embodiment, only three contact sizes are used, requiring the machine to be able to discriminate between three different patterns of the projections 35. Thus two switches 37 are sufficient to provide the signals corresponding to and identifying the contact sizes.

A number of wire size selector switches 39 and light emitting diodes 41 are located on the front face 25 of the housing 23. The wire size selector switches 39 are electrically connected to a crimper setting circuit (described below), which is connected to and controls a stepper motor 40. The stepper motor 40 is mechanically connected to a crimper adjustment knob 41, which is mechanically connected to a crimper (not shown).

A machine operator (not shown) actuates one of the wire size selector switches 39 to provide a signal identifying the size of wire the operator intends to crimp. When a wire size selector switch 39 is actuated, the light emitting diode 41 located adjacent to the switch 39 illuminates to indicate the wire size selected.

The crimper setting circuit (not shown) accepts the signals from the container switches 37 and the signal from the chosen selector switch 39, and generates a signal which causes a stepper motor 40 to set the crimper adjustment knob 41. Thus, the crimper (not shown) is set to a crimping depth which is appropriate for the size of the contacts in the container 33 and 15 selected wire size.

A total of five seven-segment light emitting diode displays 43, 45, and 47 display the size of the wire inserted into the wire orifice 31, the size of the contacts in the container 33, and the crimper setting, respectively. The circuits which drive displays 43, 45, and 47 will be described below.

Referring now to FIGS. 3 and 4, the sensor assembly 29 is comprised of two identical sensor members 51. At one end 53 each of the sensor members 51, a light emitting diode 55 frictionally engages and is electrically isolated from a light emitting diode receptacle 57. Light emitting diode leads 59 and 61 are connected to a source of dc electrical current (not shown). At an opposing end 65 of the sensor member 51, a photo diode 67 frictionally engages and is electrically isolated from a photo diode receptacle 69. One photo diode lead 71 is connected to a source of dc electrical power (not shown) and the other lead 73 is connected to an amplifier circuit (described below). The light emitting diode receptacle 57 and the photo diode receptacle 69 are connected by a light orifice 75 which provides a path for a light beam 77 to travel from the light emitting diode 55 to the photo diode 67.

The shape of the light orifice 75 is not critical; however, its dimension perpendicular to the longitudinal axis of the wire orifice 31 must be such that a wire (not shown) passing through the wire orifice 31 will partially eclipse the light beam 77. In this embodiment, the light orifice has a rectangular cross section and is 0.050×0.020 inches. The smaller dimension 79 is indicated in FIG. 4.

As stated, when a wire (not shown) is inserted through the wire orifice 31, it will partially eclipse the light beam 77. As a result, the signal produced by the photo diode 67 will be representative of the diameter of the portion of the wire which is within the light beam 77.

When two sensor members 51 are assembled to form the sensor assembly 29, a thin shim (not shown) is placed between their inner faces 80. Thus, the two light orifices 75 are displaced from each other a small distance in the direction of movement of the wire (not shown) as it is inserted through the wire orifice 31. As a result, the photo diodes 67 will produce signals representing the diameter of the wire (not shown) at two points.

FIGS. 5A–D demonstrate schematically the operation of the sensor assembly 29 (FIG. 2) as a wire 81 is inserted into the machine 21 through the wire orifice 31. As seen in FIGS. 5A–D, the distal end 83 of the wire 81 is normally stripped of insulation.

As the wire 81 passes through the light beams 77*a* and 77*b*, the light beams 77*a* and 77*b* are partially eclipsed. This causes the photo diodes 67 (FIG. 4) to produce signals representing the diameter of the wire at two points along the wire's length. When the wire 81 partially eclipses only the light beam 77*a* furthest from the crimper (not shown), as in FIG. 5B, the signal corresponding to light beam 77*a* will change to represent the diameter of the stripped end 83 of the wire 81, while the signal corresponding to the light beam 77*b* closest to the crimper (not shown) will remain unchanged. When both light beams 77*a* and 77*b* are partially eclipsed by the stripped end 83 of the wire 81, as in FIG. 5C, the signals from the photo diodes 67 are substantially equal. When the leading edge 85 of the unstripped portion 87 of the wire 81 enters the light beam 77*a* furthest from the crimper, as in FIG. 5D, the signal from the photo diode corresponding to that light beam will represent a significantly greater wire diameter than that of the signal associated with the light beam 77*b* closest to the crimper. If an unstripped wire were to be passed through the light beams 77*a* and 77*b*, they would never be exposed to differing diameters of the wire 81. As described below, the sequence of events associated with a stripped wire passing through the light beams 77*a* and 77*b* is used to allow the crimper (not shown) to be actuated.

Figure 6:
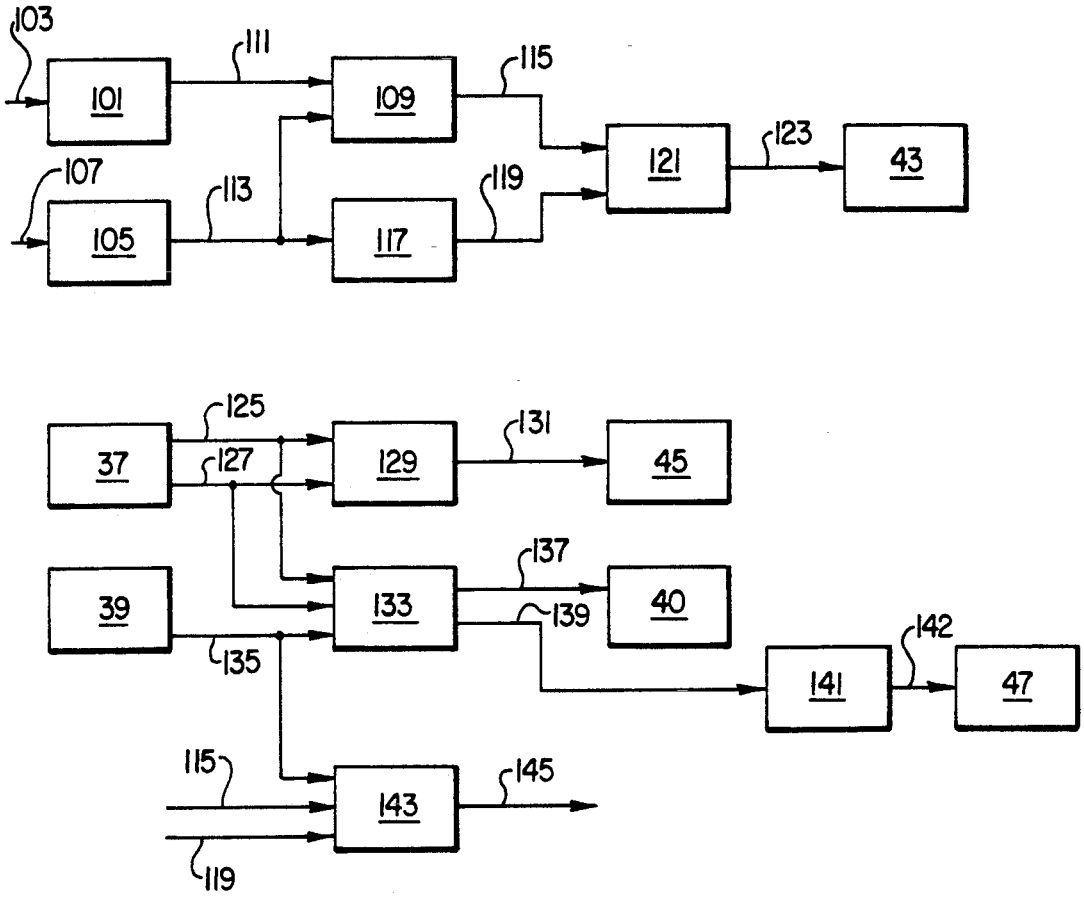
FIG. 6 is a functional block diagram of the crimping machine's control circuits.

Referring to FIG. 6, a first amplifier 101 accepts a signal 103 from the photo diode 67 (FIG. 4) associated with the light beam 77*a* (FIGS. 5A–D) furthest from the crimper. A second amplifier 105 accepts a signal 107 from the photo diode 67 associated with the light beam 77*b* nearest the crimper. A latch logic circuit 109 accepts a first amplified signal 111 from the first amplifier 101 and a second amplified signal 113 from the second amplifier 105. The latch logic circuit 109 generates a signal 115 having one of two states, LATCH and NOT LATCH. The logic of latch logic circuit 19 is such that its output 115 becomes LATCH if and only if the following conditions occur:

1. the second amplified signal 113 indicates that the light beam 77*b* nearest the crimper is partially eclipsed, that is, that a wire (not shown) is within the light beam 77*a;* and 2. the first amplified signal 111 represents a significantly larger diameter than that represented by the second amplified signal 113. Thus, the output 115 of the latch logic circuit 109 becomes LATCH when the condition shown in FIG. 5D occurs, that is, during the insertion of a stripped wire when the leading edge 85 of the unstripped portion 87 of the wire 81 enters the light beam 77*a* furthest from the crimper.

Once the output 115 of the latch logic circuit 109 becomes LATCH, it remains in that state until another wire is through the light beams 77*a* and 77*b*. When that occurs, the output 115 of the latch logic circuit 109 becomes NOT LATCH and remains NOT LATCH until the conditions required for LATCH occur.

The second amplifier 105 is also electrically connected to a wire size encoding circuit 117. The wire size encoding circuit 117 and the latch logic circuit 109 are electrically connected to a wire size display driver 121, which is electrically connected to the wire size display 43.

The wire size encoding circuit 117 accepts the second amplified signal 115 and generates a wire size signal 119 which represents the diameter of the wire partially eclipsing the light beam 77*b* nearest to the crimper. The wire size display driver 121 accepts the wire size signal 119 and the latch logic circuit signal 115. When the latch logic signal 115 is LATCH, the wire size display driver 121 generates a series of signals 123 which cause the wire size display 43 (FIG. 2) to display the size of the wire inserted in the wire orifice 31. When the latch logic circuit signal 115 is NOT LATCH, the wire size display driver 121 blanks out the wire size display 43. The wire size display 43 displays the wire size in terms of the gauge of stripped portion the wire, ie. 16–26 gauge in this embodiment. Thus, the wire size display is comprised of two seven-segment light emitting diode displays.

The container switches 37 (FIG. 2) provide signals 125 and 127, which represent the size of contact contained by the container 33, to a contact display driver 129. The contact display driver 129 generates a series of signals 131 which cause the contact size display 45 (FIG. 2) to display the size of the contacts in the container 33. The contact size is displayed in terms the gauge of the largest wire for which the contact is suitable, ie. 16, 20, and 22 gauge in this embodiment. Thus, the contact size display 45 is comprised of two seven-segment light emitting diode displays.

The container switches 37 are also electrically connected to a crimper setting circuit 133, as are the wire size selector switches 39. The crimper setting circuit 133 is electrically connected to the stepper motor 40 and a crimper setting display driver 141, which is electrically connected to the crimper setting display 47.

The container switches 37 provide the signals 125 and 127 to the crimper setting circuit 133. The crimper setting circuit 133 also accepts a signal 135 representing which one of the wire size selector switches 39 is actuated. The crimper setting circuit 133 generates a first signal 137 which causes the stepper motor 40 to set the crimper (not shown) to the proper depth setting.

In an alternate embodiment of the invention, the crimper setting circuit 133 is configured to respond to the container switch signals 125 and 127 and the wire size signal 119.

The crimper setting circuit 133 also generates a second signal 139 which is directed to a crimper setting display driver 141. The crimper setting display driver 141 generates a series of signals 142 which cause the crimper setting display 47 to display the crimp depth setting. In this embodiment, the crimper has six settings. Thus, the crimper setting display is comprised of a seven-segment light emitting diode display.

The wire size selector switches 39, the latch logic circuit 109, and the wire size encoding circuit 117 are also electrically connected to a crimper enable circuit 143.

The crimper enable circuit 143 accepts the wire size selector switch signal 135, the wire size signal 119, and the latch logic circuit signal 115, and generates a signal 145 which allows the crimper (not shown) to be actuated when both the following conditions occur:

1. the latch logic signal 115 is LATCH; and
2. the wire size signal 119 and the wire size selector switch signal 135 represent the same size of wire.

In this manner, the crimper enable circuit 143 prevents actuation of the crimper (not shown) when the size of the wire inserted in the wire orifice 3 (FIG. 2) differs from the wire size selected using one of the wire size selector switches 39, or when an unstripped wire is inserted. Thus, the present invention prevents loose crimps, crushed connectors, and crimping connectors on unstripped wires.

The preferred method of operating the wire crimping machine is as follows:

1. select a container 33 having the size contacts desired and mount it on the housing;
2. group the wires to be crimped by size;
3. actuate the wire size selector switch 39 corresponding to the size of the wires in the group;
4. strip the wires;
5. individually insert the stripped wires through the wire orifice 31 into the crimper and withdraw each wire after a contact is crimped thereon;
6. when the wire size group is completed, begin again at step 1.

While the preferred embodiment of the invention has been shown and described, it will be apparent to those skilled in this art that various modifications may be made to this embodiment without departing from the spirit of the present invention. For that reason, the scope of the invention is set forth in the following claims.

We claim:

1. A machine for crimping an electrical contact onto an electrical wire comprising:

means for disposing said contact to receive an end portion of said wire;

means for crimping said contact onto said wire end portion;

means for actuating said crimping means when said wire end portion and said contact are suitably positioned for crimping;

a first light source/sensor pair disposed adjacent to said crimping means and substantially on a transverse axis of said wire end portion as said wire is inserted into said crimping means, said first light source/sensor pair being disposed on opposing sides of said wire end portion and directed theretoward;

a second light source/sensor pair disposed in substantially the same manner as said first light source/sensor pair, the first and second light source/sensor pairs being disposed relative to each other to simultaneously allow said wire end portion to eclipse a portion of the light beam from said second light source to said second light sensor and a portion of said wire immediately adjacent to said wire end portion to eclipse a portion of the light from said first light source to said first light sensor; and a processing unit for receiving a signal from each light sensor, and signals being representative of the light received by the respective light sensors, and generating a first signal representing whether the wire is stripped of insulation and a second signal representing the size of said wire end portion; and means for allowing said actuating means to function, said means being responsive to said first and second signals to allow said actuating means to function only if said wire end portion is stripped of insulation;

whereby said actuating means is allowed to function only if the wire size is the same as the desired wire size and the wire is stripped of insulation.

2. The crimping machine of claim 1 wherein said processing unit comprises means for comparing said light sensor signals, which means generates a signal having a first state or a second state, said first state indicating that said wire is stripped and said second state indicating that said wire is not stripped, said first state occurring when said first light sensor signal represents a diameter which is greater than that represented by said second light sensor signal, and said second state occurring when said first light sensor signal represents a diameter which is equal to or less than that represented by said second light sensor signal.

3. The crimping machine of claim 1 further comprising means for adjusting said crimping means, said adjusting means comprising:

a stepper motor for adjusting said crimping means; and a circuit for controlling said stepper motor, said circuit being responsive to signals representing the size of the contacts contained by a container which supplies contacts to said crimper and said signal representing said desired wire size.

4. The crimping machine of claim 1 further comprising means for selecting different desired wire sizes.

5. The machine of claim 4 wherein said means for selecting different wire sizes comprises a plurality of electrical switches, each switch corresponding to a different size of wire, whereby a signal representing the selected size of wire is obtained by actuating the switch corresponding to that size of wire.

6. The machine of claim 1 further comprising:

a removable container adapted to contain a plurality of said contacts of a single size and means for supplying said contacts to said contact disposing means; and means for representing the size of the contacts contained in said container.

7. The machine of claim 6 wherein said means for representing the size of the contacts contained in the container comprises:

at least one protrusion projecting outwardly from a surface of the container, the absence or presence of said protrusions and the combination thereof corresponding to the size of the contacted contained by the container; and at least two electrical switches disposed so as to be actuated by said container protrusion or protrusions, thereby providing at least two signals, which signals identify the size of the contacts contained by said container.

8. The machine of claim 1 further comprising means for adjusting said crimping means to allow said crimping means to be set to crimp a plurality of combinations of wire size and connector size.

9. The machine of claim 8 wherein said means for adjusting said crimping means is responsive to said desired wire size and said means for representing the size of said contacts.

10. A machine for crimping an electrical contact onto an electrical wire comprising:

means for disposing said contact to receive an end portion of said wire;

a crimper for crimping said contact onto said wire end portion;

means for measuring the diameter of said wire end portion at a first point and at a second point, said measuring means being disposed transversely relative to an axis along which said wire is inserted into said crimper;

said first point being disposed nearer to said crimper than said second point;

a first comparator for comparing the diameter of said wire at said first point with the diameter corresponding to a desired wire size, which comparator provides a signal indicative of whether the diameter of said wire corresponds to said desired wire size; and a second comparator for comparing the diameter of said wire at said second point with the diameter of said wire at said first point, which comparator provides an output signal which indicates whether said wire is stripped of insulation.

11. The crimping machine of claim 10 further comprising:

an actuator for actuating said crimper, said actuator being responsive to the output signals of said first and second commparators, whereby said actuator is allowed to operate only if said wire size is equal to the desired wire size and the wire is stripped of insulation.

12. The crimping machine of claim 11 further comprising means for selecting different desired wire sizes.

13. The machine of claim 12 wherein said means for selecting the different wire sizes comprises a plurality of electrical switches, each switch corresponding to a different size of wire, whereby a signal representing the selected size of wire is obtained by actuating the switch corresponding to that size of wire.

14. The machine of claim 10 further comprising:

a removable container adapted to contain a plurality of said contacts of a single size and means for supplying said contacts to said contact disposing means; and means for representing the size of the contacts contained in said container.

15. The machine of claim 14 wherein said means for representing the size of the contacts contained in the container comprises:

at least one protrusion projecting outwardly from a surface of the container, the absence or presence of said protrusions and the combination thereof corresponding to the size of the contacts contained by the container; and at least two electrical switches disposed so as to be actuated by said container protrusion or protrusions, thereby providing at least two signals, which signals identify the size of the contacts contained by said container.

16. The machine of claim 10 further comprising means for adjusting said crimping means to allow said crimping means to be set to crimp a plurality of combinations of wire size and connector size.

17. The machine of claim 16 wherein said means for adjusting said crimping means is responsive to said desired wire size and said means for representing the size of said contacts.

* * * * *